US008089428B2

(12) United States Patent
Yaguchi et al.

(10) Patent No.: US 8,089,428 B2
(45) Date of Patent: Jan. 3, 2012

(54) FLAT PANEL DISPLAY APPARATUS

(75) Inventors: Tomio Yaguchi, Sagamihara (JP); Kiyoshige Kinugawa, Chosei (JP); Shigeyuki Nishitani, Mobara (JP); Takahiko Muneyoshi, Musashimurayama (JP); Susumu Sasaki, Chiba (JP); Shoichi Uchino, Annaka (JP); Akiko Iwata, Tokyo (JP); Makoto Okai, Tokorozawa (JP); Tetsuya Yamazaki, Fujisawa (JP); Nobuaki Hayashi, Kunitachi (JP)

(73) Assignees: Hitachi Displays, Ltd., Chiba-ken (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 1396 days.

(21) Appl. No.: 11/585,224

(22) Filed: Oct. 24, 2006

(65) Prior Publication Data

US 2007/0145902 A1 Jun. 28, 2007

(30) Foreign Application Priority Data

Oct. 25, 2005 (JP) ..... 2005-310014

(51) Int. Cl.
*G09G 3/30* (2006.01)

(52) U.S. Cl. ..... 345/76; 345/77; 345/82; 315/169.1; 315/169.2; 315/169.3; 313/495; 313/496; 313/497

(58) Field of Classification Search ..... 345/75.2, 345/76, 77, 82; 315/160, 167, 169.1–169.3; 313/495, 496, 497
See application file for complete search history.

(56) References Cited

U.S. PATENT DOCUMENTS

| | | | | |
|---|---|---|---|---|
| 2002/0008482 | A1* | 1/2002 | Konuma | 315/169.3 |
| 2003/0011314 | A1* | 1/2003 | Numao | 315/169.3 |

FOREIGN PATENT DOCUMENTS

| | | |
|---|---|---|
| JP | 11-231834 | 8/1999 |
| JP | 2000-133116 | 5/2000 |
| JP | 2002-023688 | 1/2002 |
| JP | 2002-055652 | 2/2002 |

* cited by examiner

*Primary Examiner* — Richard Hjerpe
*Assistant Examiner* — Saifeldin Elnafia
(74) *Attorney, Agent, or Firm* — Antonelli, Terry, Stout & Kraus, LLP.

(57) ABSTRACT

In an image display apparatus using an FED or an organic EL element, image display that is high in illumination uniformity and high in image quality can be performed. A display element with a matrix structure which conducts linear sequential driving which determines the luminance by a current is used, a threshold voltage of a cathode line immediately before one select period has been terminated where a control electrode line is sequentially driven is measured by a threshold voltage measuring section, the measured threshold voltage is recorded for each of the pixels, and a driving signal at the time of selecting the pixel is corrected by using the value of the recorded threshold voltage, to thereby control electric charge that is emitted from a cathode.

8 Claims, 12 Drawing Sheets

FLAT PANEL DISPLAY APPARATUS

CLAIM OF PRIORITY

The present application claims priority from Japanese Application JP 2005-310014 filed on Oct. 25, 2005, the content of which is hereby incorporated by reference into this application.

BACKGROUND OF THE INVENTION

1. Technical Field

The present invention relates to a flat panel display apparatus that employs light emitting elements whose luminance mainly changes according to a current, and controls the quantity of electric charge which intermittently flows into a light emitting section to adjust the illumination luminance, and more particularly to a flat panel display apparatus that is capable of suppressing a luminance variation which is caused by a difference in an electron emission start voltage which is a threshold value at which electrons are emitted from a cathode that is an electron source to start the illumination.

2. Technical Background

There exists a current driven display element having an illumination intensity determined according to the quantity of electric charge that is inputted to an illumination layer from an electron emission source within a given period of time, that is, according to a current. As examples of the current driven display element, there are a field emission display (hereinafter referred to as "FED"), and an organic electro luminescence display (hereinafter referred to as "organic EL").

The FED irradiate a phosphor screen with an electron beam from a large number of cold cathode electron sources that are formed for each of plurality of pixels through a vacuum, to thereby obtain illumination.

Also, there are several types of FEDs which are classified by the electron sources to be applied, such as a Spindt type using a fine conical electron source, a type using electron sources that are called "surface conduction type", a type using MIM electron sources with an ultrathin film of an oxide film, and a CNT-FED using a carbon nano tube (hereinafter referred to as "CNT"). Even in the case using any electron sources, the illumination intensity is determined according to a voltage of the phosphor screen that is an illumination layer, and the quantity of irradiation of electron beams onto the phosphor screen within a given period of time, that is, a current.

Since a high voltage of several kV or higher is employed as the voltage of the phosphor screen from the viewpoint of the characteristic of a phosphor, it is general to apply a DC voltage, and the luminance of the FED changes according to the quantity of incident electron beams that is a phosphor screen current thereof.

Under the circumstances, the quantity of incident electron beams is determined by changing the electron emission quantity from the electron sources, and for example, in the Spindt type or the CNT-FED, the electron emission quantity from the electron sources is controlled by applying an appropriate voltage to a cathode and a control electrode.

Also, the MIN type or the surface conduction type is not configured by the cathode and the control electrode, and both of those types extract a part of current that flows by applying a voltage between two electrodes to vacuum as electron emission.

On the other hand, the organic EL injects electrons from the cathode and electron holes from the anode into an illumination layer that is formed in each of pixels, to thereby obtain illumination. An energy that is developed by recombination of the electrons and the electron holes which have been injected into the illumination layer that is an organic thin film together causes an exciting state within the illumination layer, and the exciting state is relieved to perform the illumination. Therefore, the illumination intensity of the organic EL is roughly determined according to the number of electrons and electron holes which are injected into the illumination layer within a unit time.

That is, the illumination intensity is determined according to a current that flows in the illumination layer from the anode toward the cathode, and it is general that the illumination intensity is controlled according to the voltage that is applied to the anode and the cathode (hereinafter, the electron emission from the cathode in the FED and the electron injection from the anode in the organic EL are called "electron emission".

As described above, both of the FED and the organic EL are driven by the voltage by applying a given electrode voltage although the illumination intensity of those elements is determined according to the current. In this case, a difference of the electrode voltage to electron emission characteristics in each of the plurality of pixels is affected, and there is the possibility that a difference occurs in the luminance between the respective pixels even in the case where a given electrode voltage is applied.

In order to prevent the above drawback, it is studied to directly control the current that flows in the elements, and a conventional art that applies the direct control of the current to the organic EL is disclosed in Japanese Patent Laid-Open No. H11-231834.

In Japanese Patent Laid-Open No. H11-231834, the illumination intensity of the organic EL is controlled by driving the organic EL by means of a constant current source that is connected to the cathode. Further, a floating capacitance is charged by another constant current source of the large capacitance or a constant voltage source at the time of transiting from non-selection to selection in the respective cathodes. As a result, a period of time required to charge the floating capacitance is shortened, and the rising characteristic of illumination at the time of selecting the cathode is so improved as to enhance the response.

Also, a display element such as the FED or the organic EL has a matrix structure, and uses a linear sequential display method in which any one of two kinds of electrodes that constitute a matrix is sequentially selected.

The above driving method includes the combination of two states consisting of a selection period that is a short period of period and a non-selection period that is a relatively long period of time in the respective pixels. Because one selection period is short in the period of time, it is difficult for an observer to recognize a change in the luminance in the selection period. Therefore, even in the case where illumination is conducted with a constant luminance during the selection period, or even in the case where illumination is intensely conducted in a short period of time during the selection period, they are recognized as the same luminance if the luminance integration within one selection period is identical with each other.

Japanese Patent Laid-Open No. 2000-133116 discloses a conventional art that applies, to the FED, a method in which the total quantity of charge that flows into the cathode from a cathode power source is controlled by using the above phenomenon within one selection period to control the integrated illumination intensity within one selection period. Also, Japanese Patent Laid-Open No. 2002-23688 discloses a conventional art that also applies the above method to the organic EL.

Those conventional arts use a method of emitting electric charges that have been accumulated once in the floating capacitance or an external capacitative element from the cathode in a pulsed fashion.

The display element such as the FED or the organic EL is naturally large in areas where electrodes are disposed opposite to each other because of the provision of a matrix structure, and has a floating capacitance in each of the electrodes. In addition, the display element is capable of correcting the capacitance of the electrodes by the aid of an external capacitance. A reduction in the variation of the total capacitance is easily conducted as compared with a reduction in the variation of the voltage-current characteristics of the electron emission element, thereby making it possible to reduce a luminance variation of the respective pixels. In addition, because the electric charges that are accumulated in the known capacitative element are determined according to a charging voltage that is applied to the capacitative element, it is possible to use a constant voltage source that is simple in the structure for driving.

FIG. 3 shows an inter-electrode voltage-electron emission characteristic, that is, a so-called voltage-current characteristic of the FED that is an object of the present invention, and FIG. 11 shows an example of the inter-electrode voltage-element current characteristic of the organic EL.

In any of the elements, as shown in FIG. 3, an electron emission start voltage is developed between a control electrode and a cathode in the FED, and as shown in FIG. 11, a threshold value indicative of an illumination start voltage exists in the inter-electrode voltage between the anode and the cathode in the organic EL. Each of those elements has such a characteristic that no current flows in the element when the voltage is equal to or lower than the threshold value, and a current starts to rapidly flow in the element when the voltage exceeds the threshold value to perform illumination (hereinafter referred to as "electron emission start voltage"including the illumination start voltage since the illumination starts due to the electron emission from the cathode even in the organic EL element shown in FIG. 11).

As described above, in order to cause the electron emission from the cathode, it is necessary to supply the sum of an electric charge Qc required until the inter-electrode voltage reaches the electron emission start voltage and an electric charge Qe required to obtain the illumination with a given luminance. Because the electric charge Qc is greatly affected by the floating capacitances of cathode lines and anode lines, a variation in the thickness of an insulating film which determines the floating capacitance in the electric charge Qc affects the required quantity of electric charge Qc.

Under the above circumstances, Japanese Patent Laid-Open No. 2002-55652 discloses a conventional art that combines an electron emission start voltage setting corresponding to the variation in the thickness of the insulating film with the electric charge injection for emission to suppress the variation in the luminance of the respective pixels.

In the above conventional art, in a first period of the pixel selection time, the cathode is applied with voltage V1 so that the inter-electrode voltage is slightly lower than the electron emission start voltage even if the electron emission voltage is applied to the control electrode while the electron emission suppression voltage is applied to the control electrode, and electrically charged.

Then, after a voltage for charging the electric charge Qe to be further emitted is applied to the cathode electrode in addition to the voltage V1, the electron emission voltage is applied to the control electrode. As a result, the electron emission that is improved in the uniformity can be performed by only the voltage source.

SUMMARY OF THE INVENTION

In the method in which the electrode is electrically charged by the constant voltage source or the constant current source which is disclosed in Japanese Patent Laid-Open No. 11-231834 in the first period, and the luminance is controlled by the constant current source in a second period, there arise not only such a problem that the constant current source that is complicated in the configuration as compared with the constant voltage source needs to be provided to make the apparatus expensive, but also such a problem that setting of the charging conditions (voltage, current, time) in the first period is difficult, and is incapable of coping with a temporal change in the element state of the respective pixels.

Also, in the methods of controlling the electric charge which are disclosed in Japanese Patent Laid-Open Nos. 2000-133116 and 2002-23688, because the floating capacitance is utilized so that the apparatus can be realized by substantially the same circuit configuration as that of the voltage driving, the driving circuit is not complicated, but the existence of the electron emission start voltage which is the characteristic of the cathode is not taken into consideration. For that reason, there arises such a problem that the quantity of emitted electric charge from the cathode is reduced as much as the quantity of electric charge required for changing the electrode voltage to the start voltage without contribution to the electron emission.

A conventional art that copes with the above problem and takes the electron emission start voltage into consideration is disclosed in Japanese Patent Laid-Open No. 2002-55652. However, in the conventional art disclosed in Japanese Patent Laid-Open No. 2002-55652, a correction that takes the electron emission start voltage into consideration is subjected to only the thickness of the insulating film at the time of manufacture, that is, the floating capacitance between the electrodes. In the cathode of the FED to which Japanese Patent Laid-Open No. 2002-55652 is applied, the surface state changes due to the gas adsorption within the atmosphere that is in contact with the surface of the cathode. The state change of the cathode surface occurs during an evacuating process or the display operation after the electrodes have been formed, which may lead to a fear that there occurs a temporal change of the electron emission start voltage.

Also, the art disclosed in Japanese Patent Laid-Open No. 2002-55652 does not take a change in the electron emission start voltage after the formation of the electrode structure or during operation after that time into consideration. In addition, although the art disclosed in Japanese Patent Laid-Open No. 2002-55652 is applied to only the FED, a change in the electron emission start voltage at which the illumination starts occurs with a change in an interface state of the respective layers including the cathode during the operation even in the organic EL. As a result, a mechanism that is capable of coping with the temporal change during the operation is required.

The present invention has been made under the above circumstances, and an object of the present invention is to provide a flat panel display apparatus having a driving mechanism that controls the quantity of electric charge which is emitted from a cathode, and providing a mechanism that measures an electron emission start voltage that starts the illumination within the driving mechanism to provide a mechanism that detects a change in the electron emission start voltage and corrects a driving signal on the basis of the detection result in an FED or an organic EL, thereby making it possible to perform image display which is high in the illumination uniformity and high in the image quality.

In order to achieve the above object, according to the present invention, (1) there is provided a flat panel display apparatus comprising pixels that are disposed at intersection portions between a plurality of first electrode lines and a plurality of second electrode lines, a first electrode driving section that applies a voltage corresponding to a luminance signal to the first electrode lines, a second electrode driving section that applies a select voltage to the second electrode lines, a floating capacitance that temporarily holds the voltage corresponding to the luminance signal within a select period set by the select voltage, a voltage measuring section that measures the voltage of the first electrode lines immediately before the select period is terminated in a state where the first electrode lines are opened by the first electrode driving section, a recording table that records the measured voltage value, and a voltage correcting section that corrects the voltage corresponding to the luminance signal which is applied to the first electrode lines on the basis of the recorded voltage value.

Also, the flat panel display apparatus according to the present invention includes an arithmetic processing section that conducts arithmetic processing by using the voltage value that is recorded in the recording table and the newly measured voltage value, and records the arithmetic result in the recording table as a new voltage value.

Also, according to the present invention, the second electrode driving section applies a non-select voltage to the second electrode lines, and the first electrode driving section opens the first electrode lines after the first electrode driving section applies the voltage corresponding to the luminance signal to the first electrode lines to electrically charge the floating capacitance, and applies the select voltage to the selected second electrode lines.

Also, according to the present invention, an external capacitance is added to the first electrode lines.

In addition, the flat panel display apparatus according to the present invention includes (2) first electrodes that are connected to the first electrode lines, and second electrodes that are connected to the second electrode lines, wherein electrons that are emitted from the first electrodes are inputted to a phosphor screen panel through a space that is reduced in pressure so as to be lower than the atmospheric pressure, and illumination is generated from the phosphor screen to display an image.

Also, according to the present invention, when it is assumed that a first electrode voltage is Vk, a second electrode voltage is Vg, a phosphor screen voltage is Vp, a distance between the phosphor screen and the first electrode is dpk, and a distance between the phosphor screen and the second electrode is dpg, the display element that satisfies $dpk>dpg$, and $Vg<(Vp-Vk)/dpk\times(dpk-dpg)+Vk$ is used.

Also, according to the present invention, when it is assumed that a first electrode voltage is Vk, a second electrode voltage is Vg, a phosphor screen voltage is Vp, a distance between the phosphor screen and the first electrode is dpk, and a distance between the phosphor screen and the second electrode is dpg, the display element that satisfies that an absolute value of $dpk-dpg$ is equal to or smaller than the thicker film of the first electrodes and the second electrodes, and $Vg\leqq Vk$ is used.

Also, according to the present invention, a display element containing fiber carbon material is disposed on the surface of the first electrode.

Further, according to the present invention, (3) a light emitting element having an organic light emitting layer between the first electrode and the second electrode is used.

It is needless to say the present invention is not limited to the above respective configurations and configurations described in embodiments that will be described below, and can be variously changed without deviating from the technical concept of the present invention.

According to the present invention, a difference in the electron emission start voltage between the pixels, that is, in the threshold voltage, or a variation of the threshold voltage during the operation can be corrected in an image display apparatus using a display element with a matrix structure which is represented by the FED or the organic EL where the luminance is determined according to not a voltage but a current. As a result, there can be provided a flat panel display apparatus with a high quality which is capable of perform the illumination that is high in the luminance uniformity.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Now, a description will be given in more detail of embodiments of the present invention with reference to the accompanying drawings.

First Embodiment

Figure 1A:
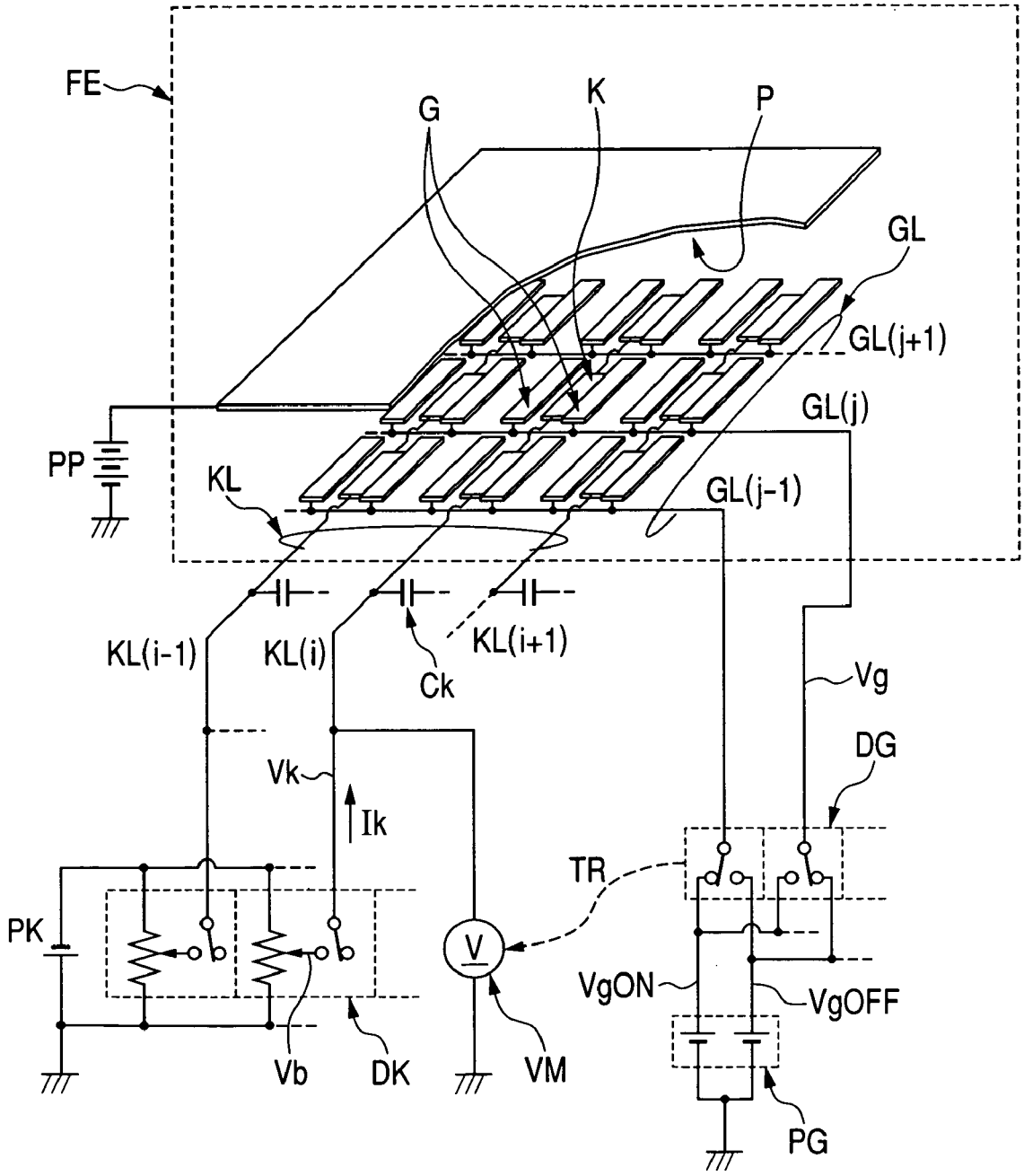
FIG. 1A is a structural diagram showing control electrode and a cathode driving section in an FED image display apparatus.
Figure 1B:
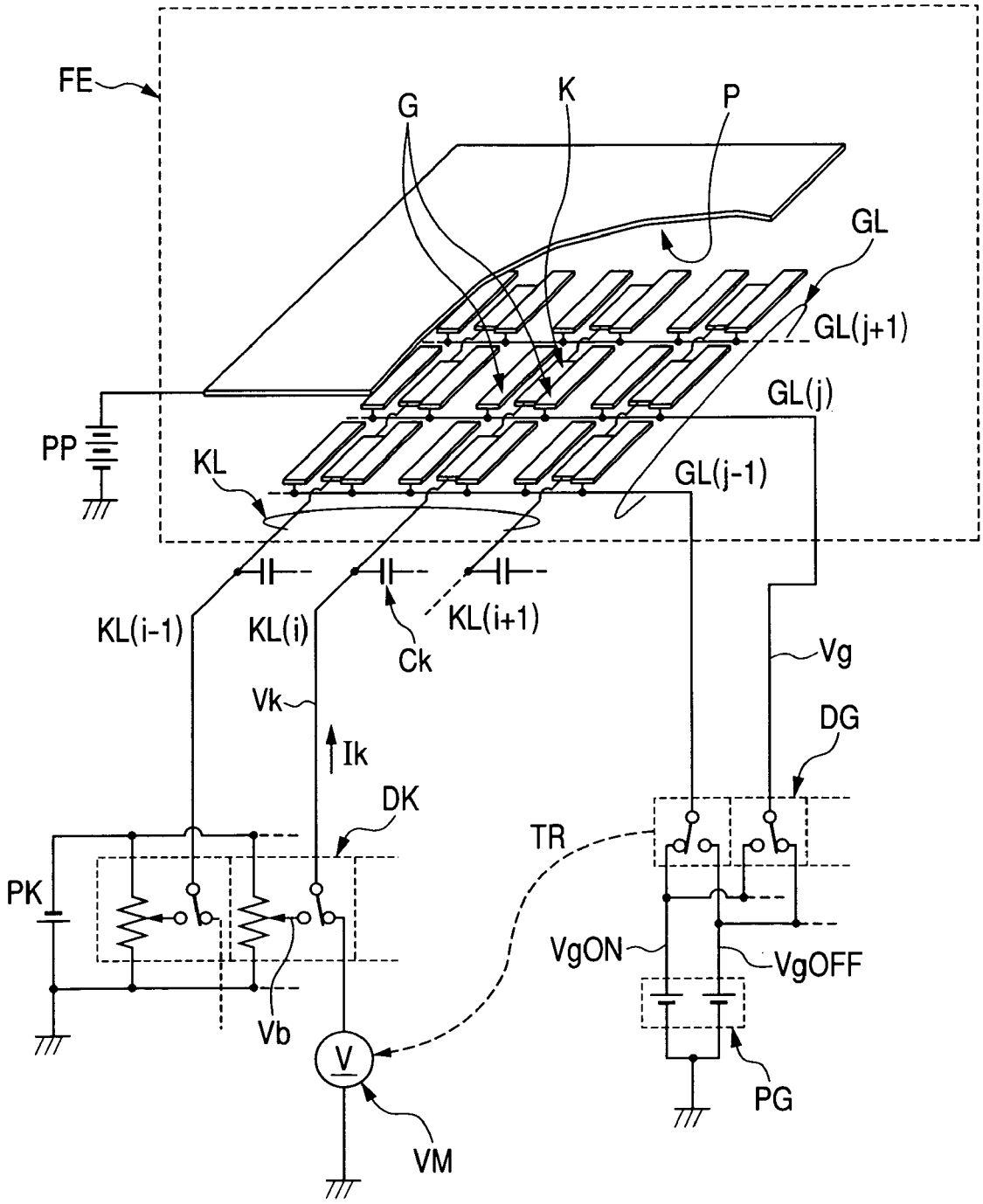
FIG. 1B is another structural diagram showing the control electrode and the cathode driving section in the FED image display apparatus.

A description will be given of a flat panel display apparatus using an FED according to a first embodiment of the present invention with reference to FIGS. 1A and 1B. FIGS. 1A and 1B are diagrams showing the configuration of a control electrode and a cathode driving section according to this embodiment.

As shown in FIGS. 1A and 1B, in this embodiment, an FED (FE) is used as a display element and mainly made up of three electrodes consisting of a cathode (K) that emits electrons, a control electrode (G) that controls the electric field of a cathode surface, and a phosphor screen (P) that emits light upon inputting electrons that have been emitted from the cathode (K).

A plurality of cathode lines (KL) and a plurality of anode lines (GL) constitute a matrix structure, and there exist, at intersection portions thereof, electron beam sources each consisting of the cathode (K) that is electrically connected to the cathode line (KL) and the control electrode (G) that is electrically connected to the control electrode line (GL). The electron beam sources create pixels in cooperation with the light emitting section on the phosphor screen (P).

The cathode lines (KL) and the control electrode lines (GL) which connect the respective electrode groups of the cathodes (K) and the control electrodes (G) constitute the matrix structure, and since opposite surfaces of those electrodes to other electrodes are large, floating capacitances Ck exist in the respective cathode lines (KL).

The cathode lines (KL) are connected with cathode driving sections (DK) that are capable of setting a voltage in each of those lines, and are capable of applying a setting voltage Vb according to a luminance signal to be emitted, and are also capable of bringing to an opened state, that is, a high impedance state by switching over the driving section.

On the other hand, the control electrode lines (GL) are connected with control electrode driving sections (DG) that select an electron emission voltage (select voltage) VgON and an electron emission suppression voltage (non-select voltage) VgOFF in each of those lines so as to apply the selected voltage to the line.

The phosphor screen (P) is connected with a phosphor screen power supply (PP) of a high voltage which is capable of supplying sufficient energy for a phosphor (not shown) that is coated on the phosphor screen (P) to emit light to electrons.

That the control electrode lines (GL) are sequentially selected is combined with that voltage outputs corresponding to the illumination intensities which are required by pixels that exist on the selected control electrode line are applied to the cathode lines (KL) side all together, to thereby conduct desired electron emission from the cathode surface that constitutes the respective pixels, and the emitted electrons allow the phosphor on the phosphor screen (P) to emit light, to thereby display a desired image.

In this embodiment, there is provided a threshold voltage measuring section (VM) which is capable of measuring a cathode line (KL) voltage Vk while controlling the operation timing according to a trigger signal (TR) that is synchronous with the operation of the control electrode driving section (DG).

The threshold voltage measurement by the threshold voltage measuring section (VM) is conducted when the cathode line (KL) is separated from the cathode power supply (PK) by the cathode driving section (DK), and is brought to the high impedance state. In FIG. 1A, the threshold voltage measuring section (VM) is connected directly to the cathode line (KL), but as shown in FIG. 1B, the measurement can be performed even when the threshold voltage measuring section (VM) is connected to a cutoff side within the cathode driving section (DK). Also, because a measurement error occurs or the quantity of emitted electrons is reduced when a large amount of current flows into the threshold voltage measuring section (VM), it is desirable that the internal impedance of the threshold voltage measuring section (VM) is high within a stable operation range.

In this embodiment, the floating capacitances Ck on the cathode lines (KL) are utilized, but in the case where the capacitance is short when only the floating capacitance is used, or in the case where a variation in the floating capacitance between the respective cathode lines is remarkably large, an external capacitance can be added to the respective cathode lines (GL). In this case, the external capacitance to be added is properly selected according to a state of the floating states of the respective cathode lines, thereby making it possible to drive that cathode even by the aid of a cathode driving section (DK) that is narrow in the voltage variable range. Since a case where the external capacitance is added is consequently identical with a case in which the floating capacitance on the cathode line (KL) is large, a description of the case in which the external capacitance is added will be omitted from the following description.

Figure 2:
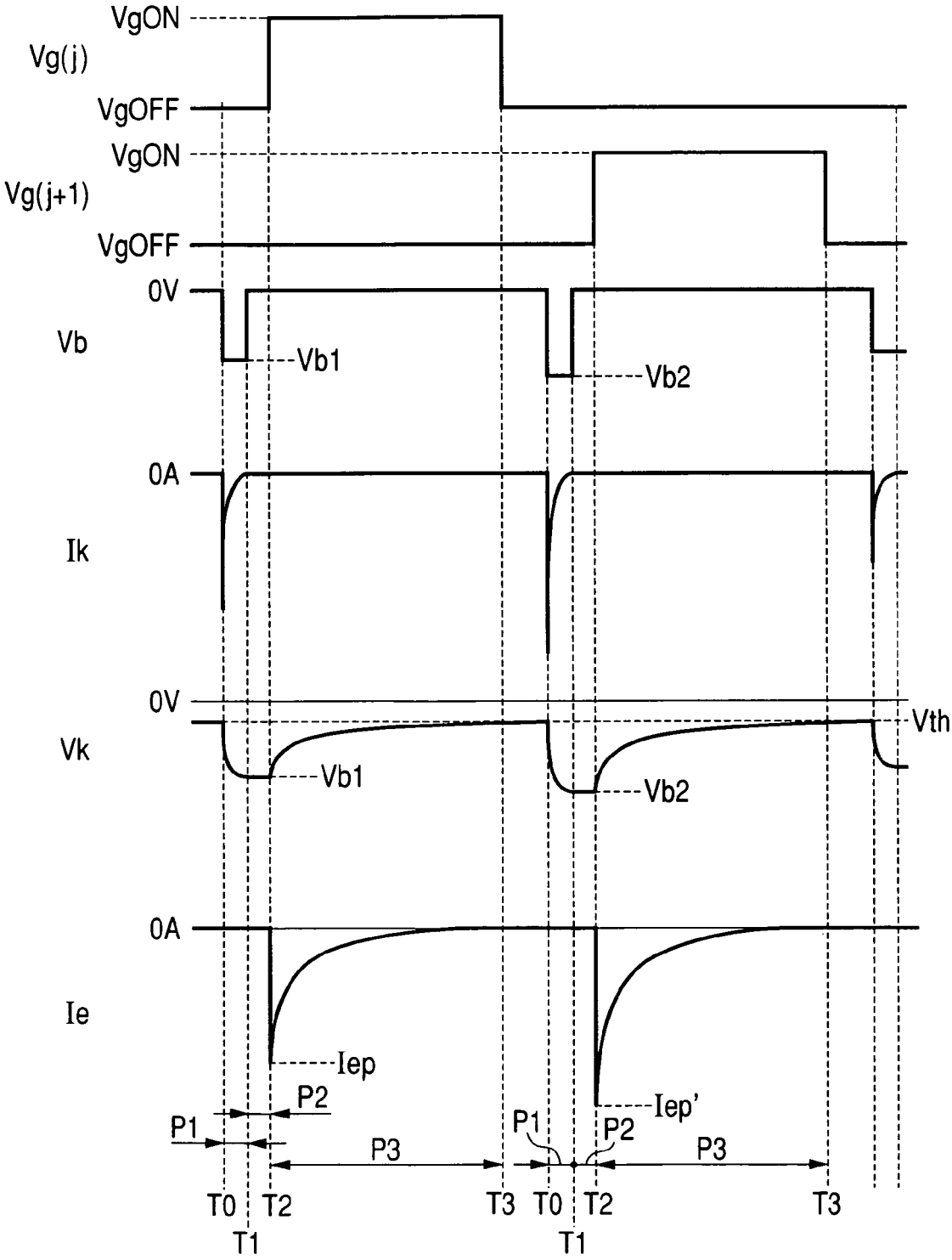
FIG. 2 is a graph showing an electrode voltage and a current change in the FED image display apparatus.
Figure 3:
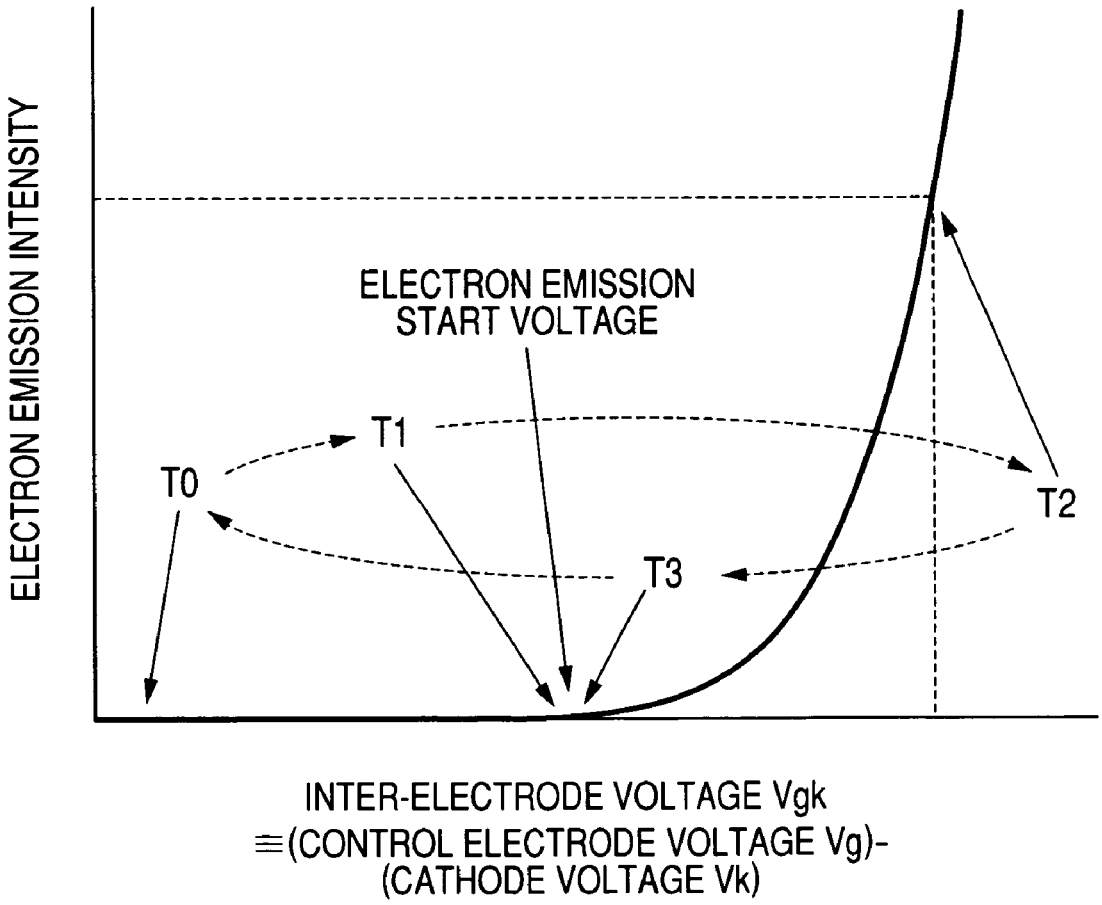
FIG. 3 is a graph showing an interelectrode voltage—electron emission intensity characteristic in the FED image display apparatus.

Hereinafter, a driving procedure in the configuration shown in FIGS. 1A and 1B will be described with reference to FIG. 2 showing a voltage change of the respective electrodes and a current change that is caused by the electron emission, and FIG. 3 showing an interelectrode voltage—electron emission intensity characteristic between the cathode and the control electrode used in the FED.

FIG. 2 shows a voltage Vg (j) of a j-th control electrode line that will form a select control line, a voltage Vg(j+1) of a subsequent select control electrode line, a cathode driving section output voltage Vb for a certain cathode line, an influx current Ik that flows into that cathode line from the driving section, a voltage Vk of that cathode line, and a current Ie that is caused by the emitted electrons from that cathode. Also, the interelectrode voltage Vgk between the control electrode and the cathode and a state of the electron emission at the respective timings shown in FIG. 2 are represented by T0 to T3 in FIG. 3.

First, the voltages of all the control electrode lines (GL) including the j-th control electrode line (GL(j)) are set to the electron emission suppression voltage VgOFF by the control electrode power supplies (PG) and the control electrode driving sections (DG) (timing 0 (T0)). In this situation, the interelectrode voltage Vgk is shown by T0 in FIG. 3, and no electron emission occurs.

In the above state, the cathode line (KL) that is connected to the cathode (K) from which electrons will occur from now is connected to the cathode power supply (PK) through the cathode driving section (DK), and electrically charged with a voltage Vb1 necessary to obtain a desired luminance (first period (P1)).

In this situation, a value of the output voltage Vb1 is determined according to a sum of the threshold voltage Vth of the cathode which is recorded in advance and a voltage that is determined according to the quantity of electric charge necessary to obtain given illumination. A method of determining the cathode driving section output voltage Vb will be described later.

Electrons flow into the cathode line (KL) that is connected with the cathode driving output of the output voltage Vb1, to thereby drop the cathode line voltage Vk toward the Vb1.

Electric charge is stored in the floating capacitance Ck that exists on the cathode line (KL), and since electron emission suppression voltage VgOFF is applied to all of the control electrode lines (GL), no electrons are emitted. The interelectrode voltage Vgk in this situation is shifted to a voltage indicated by T1 in FIG. 3, and no electrons is emitted likewise.

Subsequently, after a given electric charge has been stored in the floating capacitance Ck by the aid of the voltage Vb1, connections between the cathode power supply (PK) and all of the cathode lines (KL) are cut off by means of the cathode driving section (DK) (timing 1 (T1)). In this situation, since the floating capacitance Ck is not charged or discharged, the cathode line voltage Vk is maintained (second period (P2)).

Sequentially, a voltage Vg(j) of only the control electrode line (GL(j)) including a pixel from which electrons are to be emitted by means of the control electrode driving section (DG) switches over to the electron emission voltage VgON (timing 2 (T2)).

As a result, the control electrode voltage Vg(j) becomes VgON, the cathode voltage (Vk) becomes Vb1, and the interelectrode voltage Vgk becomes a state of T2 shown in FIG. 3 to emit electrons. Therefore, electrons are emitted from the surface of the cathode (K) that is connected to the subject control electrode line (GL(j)), thereby allowing a current Ie to flow.

With the above emission of electrons, the electric charges that have been charged in the floating capacitance Ck are discharged, and the cathode line voltage Vk rapidly changes from Vb1 to decrease the interelectrode voltage Vgk (transition from T2 to T3 in FIG. 3), and the electron emission intensity is also rapidly lowered, to thereby perform pulsed electron emission (third period (P3)). The maximum current Iep in this situation is restricted by an electric field that is applied to the surface of the cathode (K).

The interelectrode voltage Vgk becomes closer to the electron emission start voltage as the cathode line voltage Vk is closer to the threshold voltage Vth. Therefore, when a leak current from the cathode line (KL) is set to be sufficiently small, the cathode line voltage Vk does not exceed the threshold voltage Vth.

Therefore, the voltage of the cathode line (KL) becomes the threshold voltage Vth of the respective cathodes (K) which exist at the intersection points between the respective cathode lines and the j-th control electrode line (GL(j)) from which electrons are emitted immediately before the voltage Vg(j) of the select control electrode line (GL(j)) switches over from the electron emission voltage VgON to the electron emission suppression voltage VgOFF (timing 3 (T3)). Therefore, the threshold voltage Vth is measured by the threshold voltage measuring section (VM), and then stored in the threshold voltage recording table.

With the above operation, the operation of the pixels on the j-th control electrode line (GL(j)) is completed, and the same operation is conducted on pixels on a subsequent (j+1)-th control electrode line (GL(j+1)). In this way, in the case where the operation of the pixels on the j-th control electrode line (GLj) is again conducted after the same operation has been conducted on all of the control electrode lines, the voltage Vb is corrected on the basis of the value of the threshold voltage Vth that has been previously recorded, thereby making it possible to correct a variation of the threshold voltage Vth.

Hereinafter, a method of setting the output voltage Vb of the cathode driving section (DK) will be described.

The illumination luminance depends on the total quantity of emitted electrons ΔQe within the above third period. Then, the total quantity of emitted electrons ΔQe corresponds to a change in the quantity of accumulated electric charge ΔQ until the voltage Vk of the cathode line which is one electrode of the floating capacitance Ck which is disposed between the cathode line (KL) and another electrode changes from a state of Vb1 at the timing (T2) to a state of the threshold voltage Vth.

During the above period, since other electrode voltages are not changed, only the cathode line voltage Vk is taken into consideration, and the quantity of emitted electrons ΔQe satisfies the following expression:

$$\Delta Qe=\Delta Q=Ck(Vb1-Vth) \quad (1)$$

In the instantaneous electron emission intensity, an influence of the interelectrode voltage—electron emission intensity characteristic must be also taken into consideration. As is apparent from Expression (1), the total quantity of electric charge ΔQe which is emitted within one select period is determined according to only the floating capacitance Ck and a change width (Vb−Vth) of the cathode line voltage Vk. The floating capacitance can be measured at the time of completing the light emitting element such as the FED.

Since the voltage Vb to be set is the cathode output voltage Vb1, the threshold voltage Vth and a voltage width ΔVk=(Vb1−Vth) which is required for the change in the amount of electric charge ΔQe=ΔQ are obtained.

The quantity of electric charge ΔQb that needs to be emitted from the cathode within one select period can be obtained from the luminance to be emitted, the configuration and the illumination efficiency of the phosphor screen (P), and the usability of electrons which is derived from the number of scanning lines and the electrode configuration.

From the quantity of electric charge ΔQb, the required voltage width ΔVk satisfies the following expression:

$$\Delta Vk=(Vb1-Vth)=\Delta Qb/Ck \quad (2)$$

Therefore, the output voltage Vb of the cathode driving section can be obtained if the threshold voltage Vth can be obtained.

In the measurement of the threshold voltage Vth, since the cathode line voltage Vk immediately before the timing 3 (T3) through the above method can be measured, a flow of using the cathode line voltage Vk for correction of the driving section output voltage Vb will be described below with reference to FIGS. 4 to 6.

Figure 4:
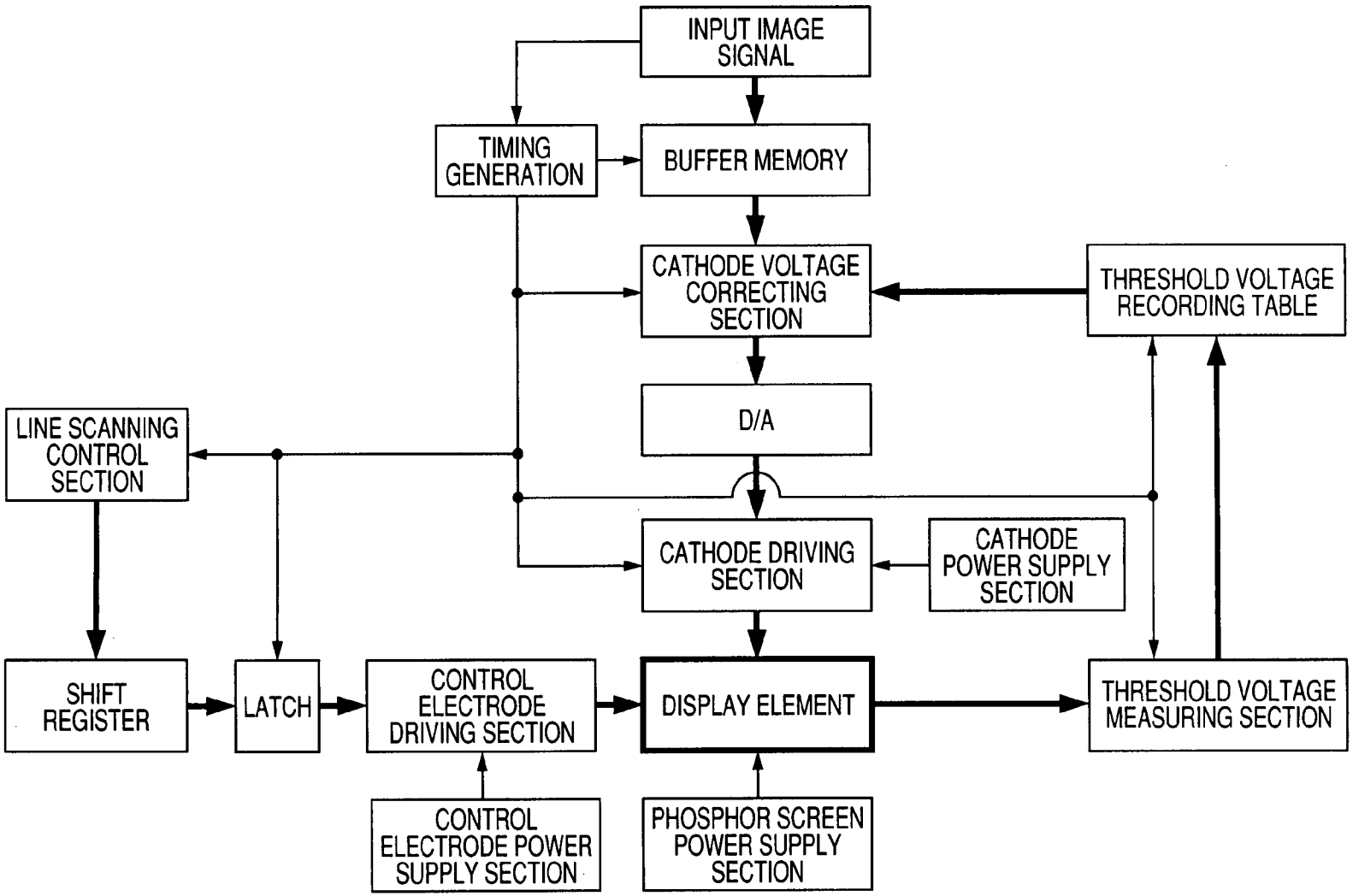
FIG. 4 is a block diagram showing the FED image display apparatus.

FIG. 4 shows an example of the configuration of the control section used in the image display apparatus. The FED shown in FIGS. 1A, 1B is used as the display element, and the connection shown in FIG. 5 is conducted.

Figure 5:
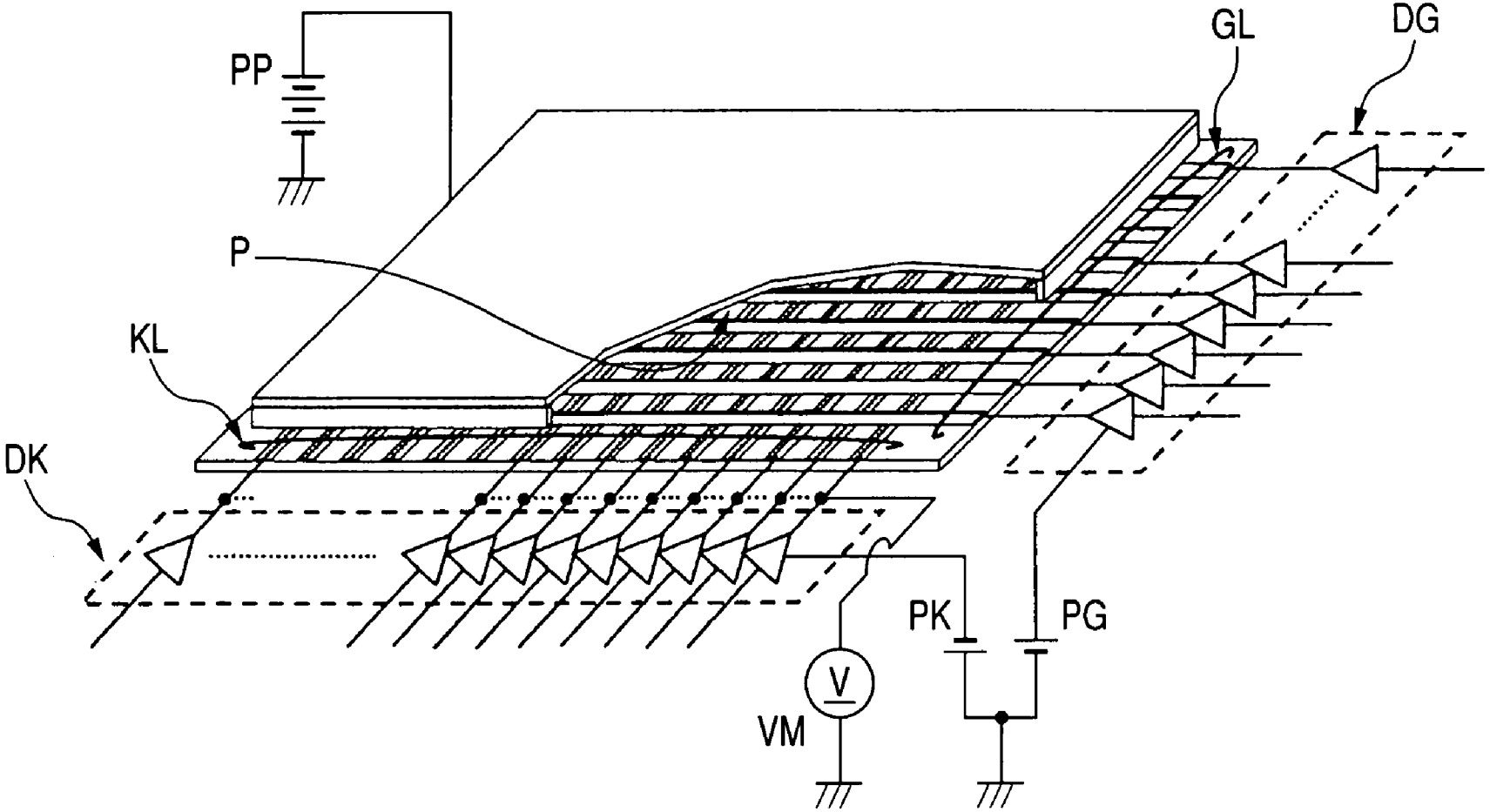
FIG. 5 is an overall structural diagram showing the FED image display apparatus.
Figure 6:
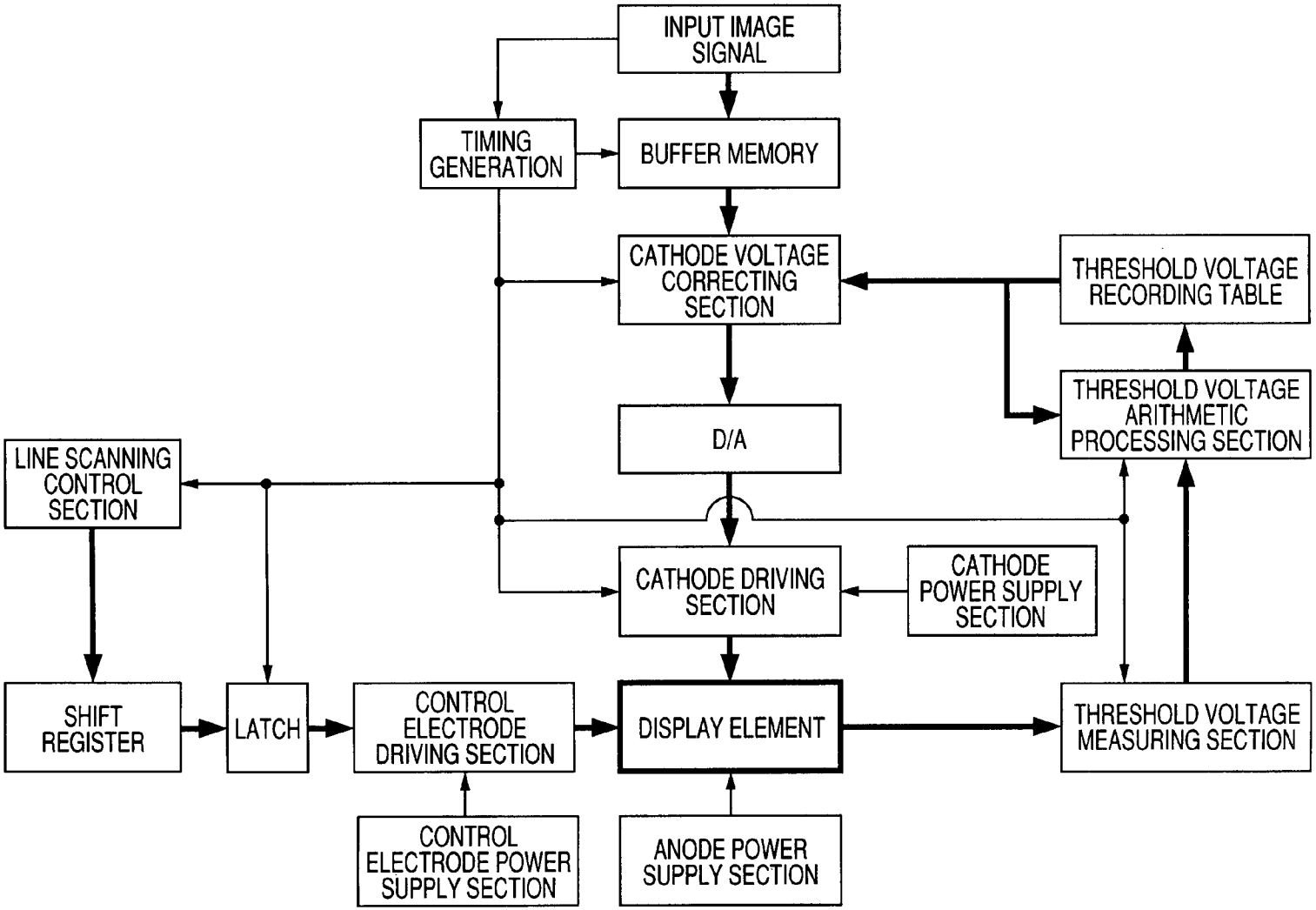
FIG. 6 is another block diagram showing the FED image display apparatus.

Referring to FIG. 5, connection is conducted through the cathode driving section (DK) that can apply different voltages to the plurality of cathode lines (KL), respectively, and the control electrode driving section (DG) that is capable of applying the electron emission voltage to none or one of the plurality of control electrode lines (GL) and applying the electron emission suppression voltage to other control electrode lines (GL).

In addition, the respective cathode lines (KL) are connected with the threshold voltage measuring section (VM), and the phosphor screen (P) is also connected with the phosphor screen power supply (PP). A flow of a signal for conducting the image display is general and therefore will be omitted.

The characteristic structural section of the present invention is the cathode driving section having a cutoff mechanism, but the structure is the same as that described with reference to FIG. 1, and therefore will be omitted.

Also, a timing signal is connected so that the operation of the threshold voltage measuring section or the threshold voltage memory table is conducted in synchronism with the image display.

The cathode line voltage Vk is measured by using the threshold voltage measuring section (VM) immediately before the control electrode voltage Vg switches over from the electron emission voltage VgON to the electron emission suppression voltage VgOFF after electrons have been emitted in a state where the connection between the cathode line (KL) and the cathode driving section (DK) is cut off as described with reference to FIGS. 1A and 1B. As a result, it is possible to measure the threshold voltage Vth of the cathode (K) that constitutes the respective pixels on the control electrode line (GL) to which the electron emission voltage VgON has been applied. The value of the threshold voltage measured as described above is recorded in the threshold voltage recording table for each of the pixels.

In the above manner, since the electron emission voltage VgON is sequentially applied to the plurality of control electrode lines (GL), the threshold voltages Vth of the respective cathodes are measured in synchronism with the application of the electron emission voltage VgON, thereby making it possible to measure and record the threshold voltage Vth of the cathodes of all the pixels.

FIG. 5 shows only the measuring section of one system as the threshold voltage measuring section (VM), but the respective cathode lines (KL) are connected with the threshold voltage measuring section (VM), and it is possible to measure the threshold voltages of all the cathodes that constitute the pixels on the control electrode line (GL) every time one of the control electrode lines (GL) is selected and driven.

In this embodiment, since a structure is made to provide the threshold voltage measuring sections (VM) of the same number as that of the cathode lines, the threshold voltages Vth for all of the pixels can be measured every time all of the control electrodes are sequentially selected, and one screen is displayed, and the variation of the threshold voltage can be corrected on a real-time basis.

However, since the threshold voltages Vth of all the pixels can be measured as being sequentially by the provision of another cathode line switching mechanism, the effects of the present invention can be obtained by providing the threshold voltage measuring sections (VM) of the systems of the smaller number than that of cathode lines in the case where the variation of the threshold voltage Vth is gentle.

The threshold voltage value that has been recorded in the threshold voltage recording table is read when the subject pixel is selected next time or later, and the image signal that is an input signal as well as the cathode driving section output voltage Vb is determined on the basis of Expression (2). The determined voltage Vb is transmitted to the cathode driving section through a D/A conversion, and actually applied to the cathode line of the display element.

The threshold voltage measurement, recording, reading, the cathode driving section output voltage determination, and the cycle of voltage supply as described above are repeated, thereby making it possible to correct a change in the luminance in the case where the threshold voltage Vth is varied.

In FIG. 4, the threshold voltage is directly recorded in the threshold voltage recording table in order to measure the threshold voltage Vth. Alternatively, arithmetic processing using a value that is newly measured and a value that has been recorded in advance is conducted as shown in FIG. 6, and its result can be recorded in the threshold voltage recording table as a new value.

As the arithmetic operation, for example, a weighted averaging process is conducted, thereby making it possible to suppress an influence of exogenous noises or the sporadic threshold voltage change to prevent the excessive correction. It is needless to say that the contents of the arithmetic operation are not limited to the averaging but applicable to a large number of methods.

In the case of using the FED as the display element, electrons that are emitted from the cathode (K) are inputted to the phosphor screen (P), to thereby obtain illumination, and the quantity of electron emission from the cathode (K) is so controlled as to control the illumination intensity.

From the viewpoint of the electrode structure, the electron emission start voltage depends on the interelectrode voltage—electron emission intensity characteristic even in a state where a part of emitted electrons is inputted to the control electrode (G), and when the ratio of the quantity of emitted electrons and the quantity of input to the control electrode is constant, the effects of the present invention can be obtained.

However, in order to sufficiently utilize the effects of the present invention, it is desirable that no electrons is inputted to the control electrode (G), and all of the quantity of emitted charge from the cathode (K) which is controlled becomes the quantity of input charge to the phosphor screen (P).

Figure 7:
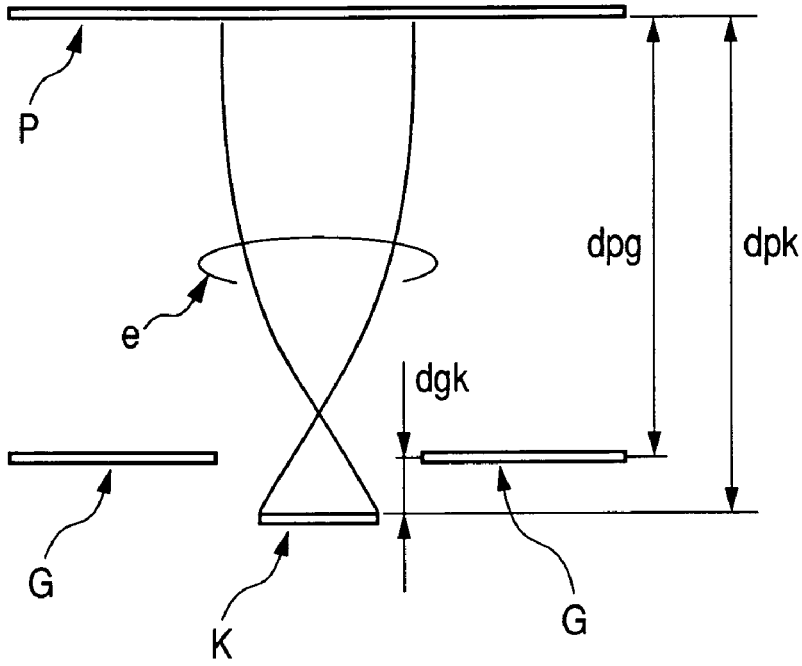
FIG. 7 is a diagram showing an example of an electrode arrangement of the FED element in which the control electrode is disposed between an anode and a cathode.
Figure 8:
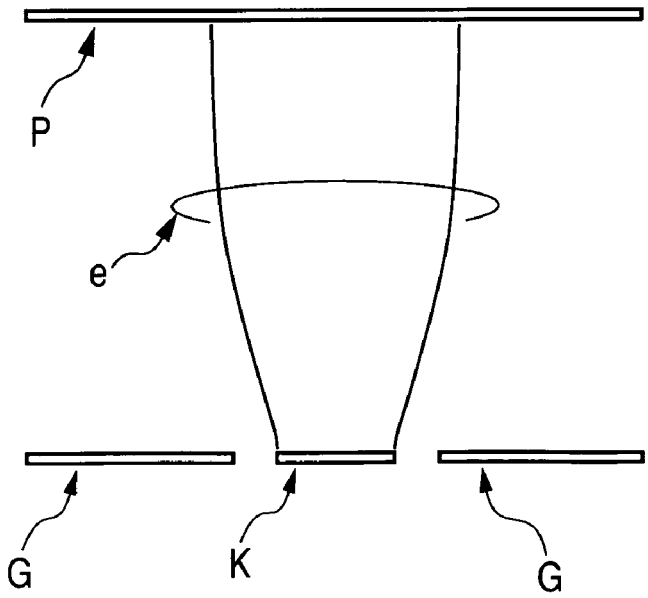
FIG. 8 is a diagram showing an example of an electrode arrangement of the FED element in which the cathode electrode and the control electrode are flush with each other.

The electrode structure of the FED which is capable of satisfying the above conditions and is also capable of effectively utilizing the present invention is shown in FIGS. 7 and 8. As shown in FIGS. 7 and 8, the FED is mainly made up of three kinds of electrodes consisting of the cathode (K), the control electrode (G), and the phosphor screen (P).

FIG. 7 shows a structure in which the control electrode (G) is disposed between the cathode (K) and the phosphor screen (P). In the structure, the electron beams that are emitted from the cathode (K) are focused in the vicinity of the control electrode (G) by driving the cathode under the conditions where $dpk>dpg$, and $Vg<(Vp-Vk)/dpk\times(dpk-dpg)+Vk$ are satisfied when it is assumed that the voltage of the cathode (K) is Vk when electrons are emitted, the voltage of the control electrode (G) is Vg, the voltage of the phosphor screen (P) is Vp, a distance between the phosphor screen (P) and the cathode (K) is dpk, and a distance between the phosphor screen (P) and the control electrode (G) is dpg. As a result, it is possible to suppress the input to the control electrode (G) as much as possible.

As a result, most of the electrons that are emitted from the cathode (K) can be inputted to the phosphor screen (P), and the effects of the present invention can be effectively utilized.

Also, as shown in FIG. 8, even when the control electrode (G) is positioned at substantially the same level as that of the cathode (K), electron input to the control electrode (G) is suppressed, and the effects of the emitted charge control can be effectively utilized. In the above electrode arrangement (hereinafter referred to as "IPG structure"), because electrons that are emitted from the cathode are emitted toward the phosphor screen (P) to which a high positive voltage is applied, the electrons do not pass through the vicinity of the control electrode (G). In particular, this phenomenon is effective in the case of using the cathode material that obtains the sufficient electron emission even by an electric field that is lower than an average electric field $Fpk=(Vp-Vk)/dpk$ . . . (3) between the phosphor screen (P) and the cathode (K), which is determined according to the phosphor screen voltage Vp, the cathode voltage Vk, and the distance dpk between the phosphor screen and the cathode.

As the above cathode material, there is a carbon fiber material whose thickness is nanometer size such as a carbon nano tube or a carbon nano fiber. The material is allowed to grow directly on abase film of the cathode, or after the material has been dispersed in a solvent, a paste that is mixed with a resin agent is printed, thereby making it possible to form the cathode that obtains the electron emission by a low electric field. For example, in the cathode that is formed by printing the pasted carbon nano tube, it is possible to obtain the sufficient electron emission by about 3 V/μm.

The IPG structure shown in FIG. 8 is formed by means of the cathode, and both of the control electrode voltage Vg and the cathode voltage Vk at the time of electron emission are zero V, and the control electrode Vg is set to −100 V or the cathode voltage Vk is set to +100 V, thereby making it possible to cut off the electron emission in the case where the distance dpk (=dpg) between the phosphor screen and the cathode (control electrode) is 2 mm, the phosphor screen voltage Vp is 6 kV, and the control electrode interval is 150 μm.

The electron beam source of the matrix operation can be constituted by combining the electrode voltage control, and as shown in FIG. 5, the FED can be constituted by the combination with the phosphor screen panel (P).

In the above description, the FED is used as the display element, and subsequently a second embodiment using an organic EL element as the display element will be described with reference to FIGS. 9 to 13.

Figure 9:
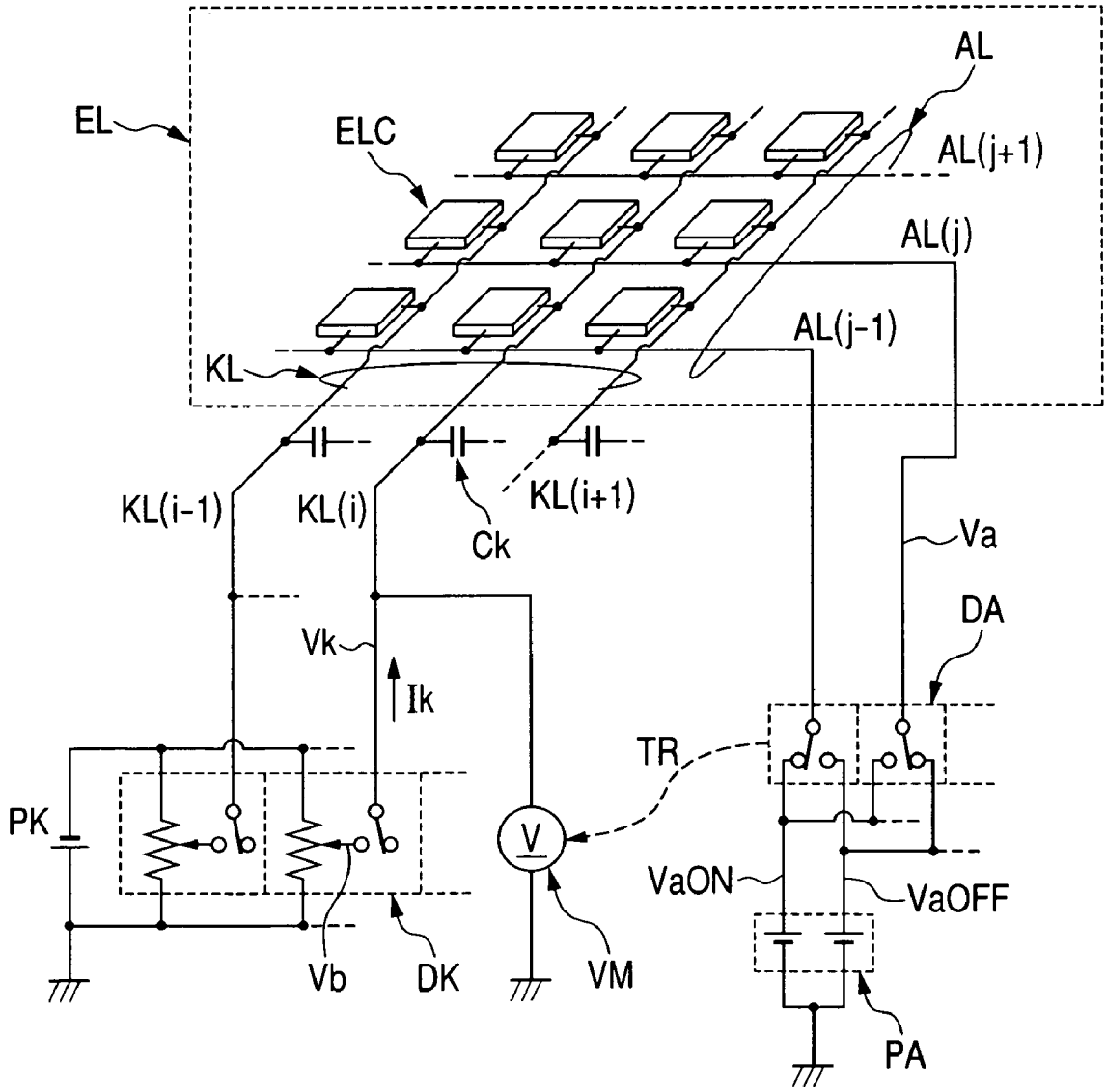
FIG. 9 is a structural diagram showing a control electrode and a cathode driving section in an image display apparatus using an organic EL element.
Figure 10:
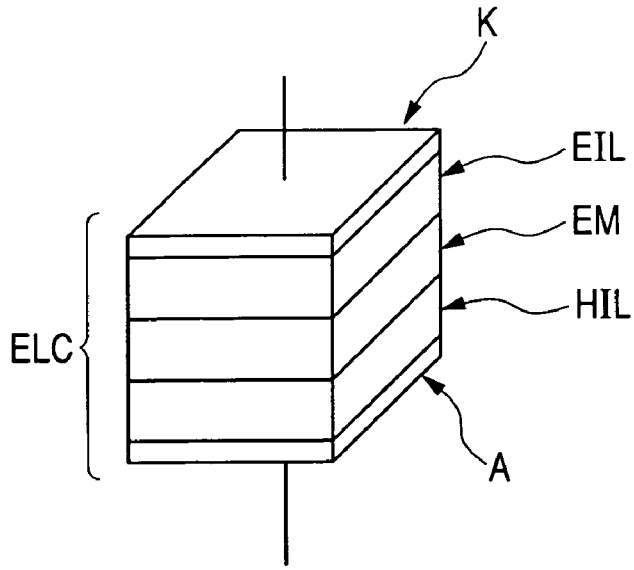
FIG. 10 is a diagram showing a film configuration of a light emitting section of the organic EL element.
Figure 11:
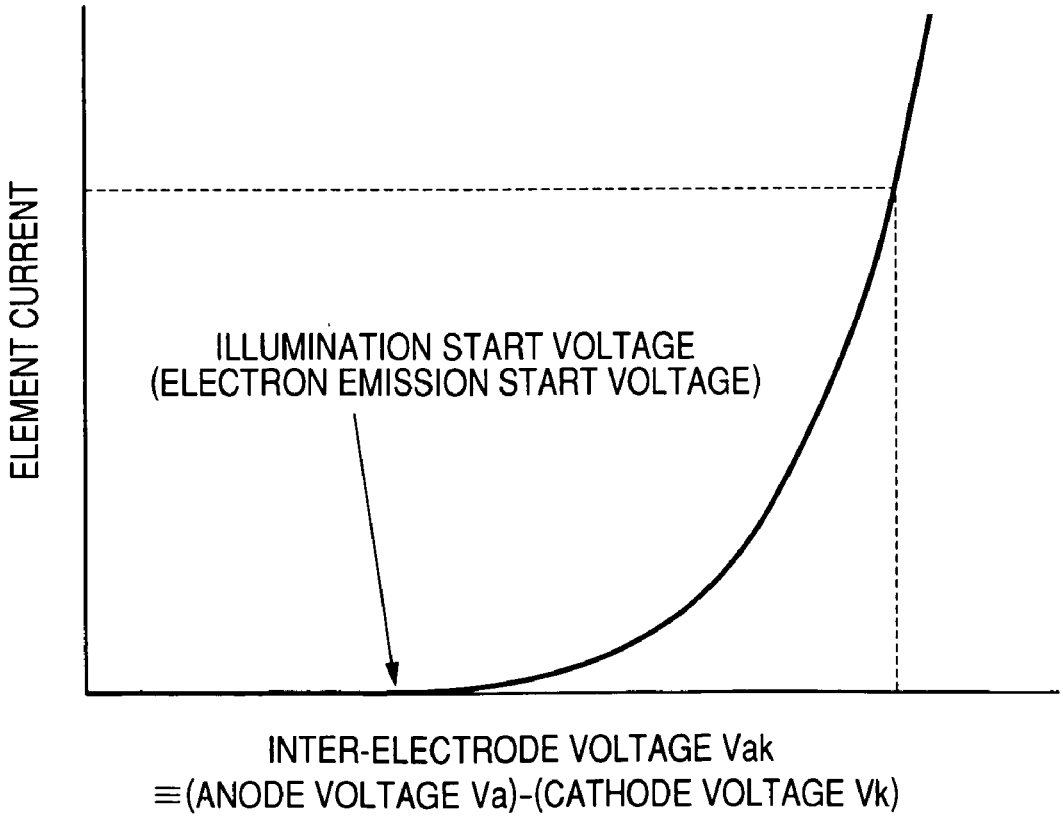
FIG. 11 is a graph showing an interelectrode voltage—element current characteristic in the organic EL element.
Figure 12:
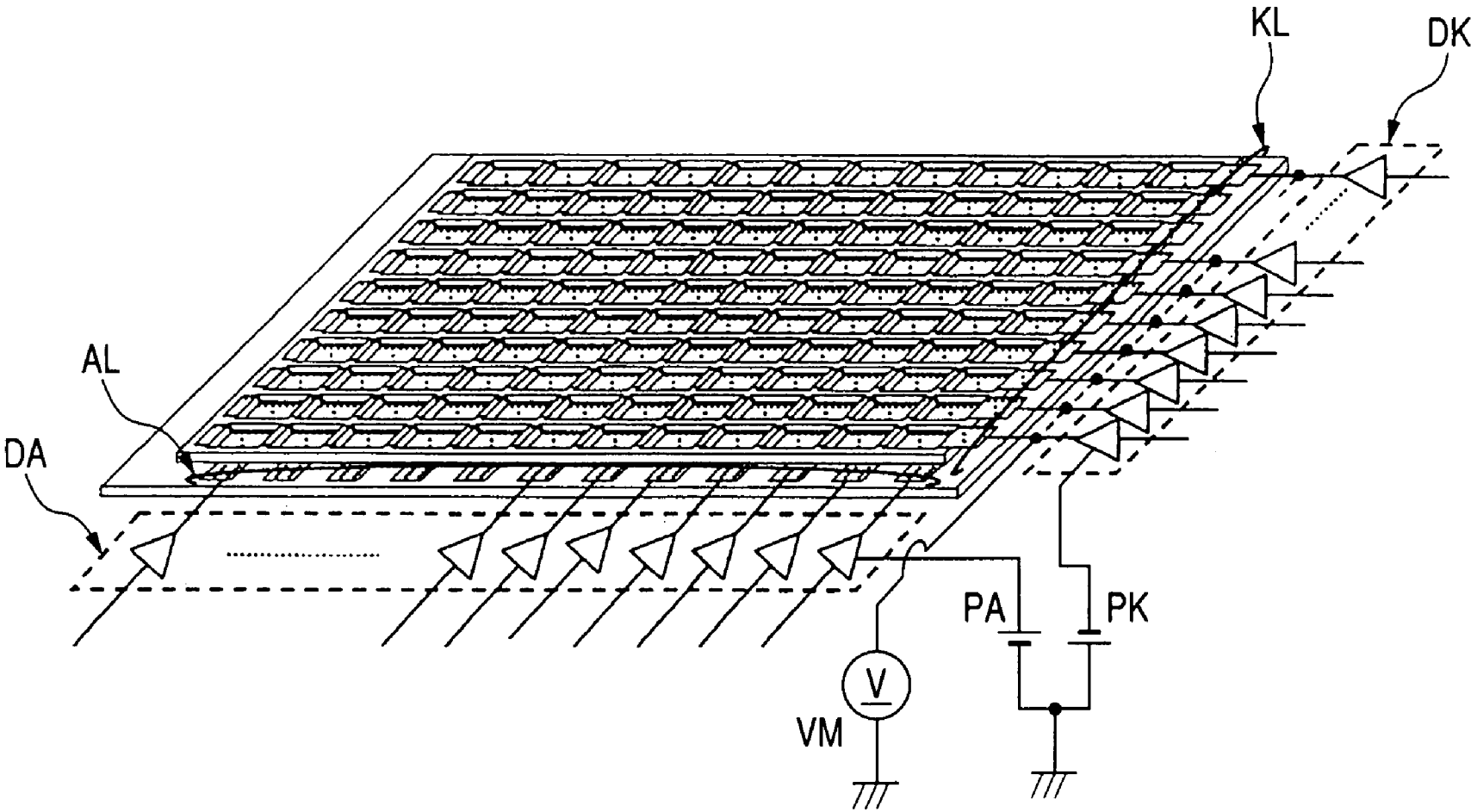
FIG. 12 is an overall structural diagram showing the image display apparatus using the organic EL element.
Figure 13:
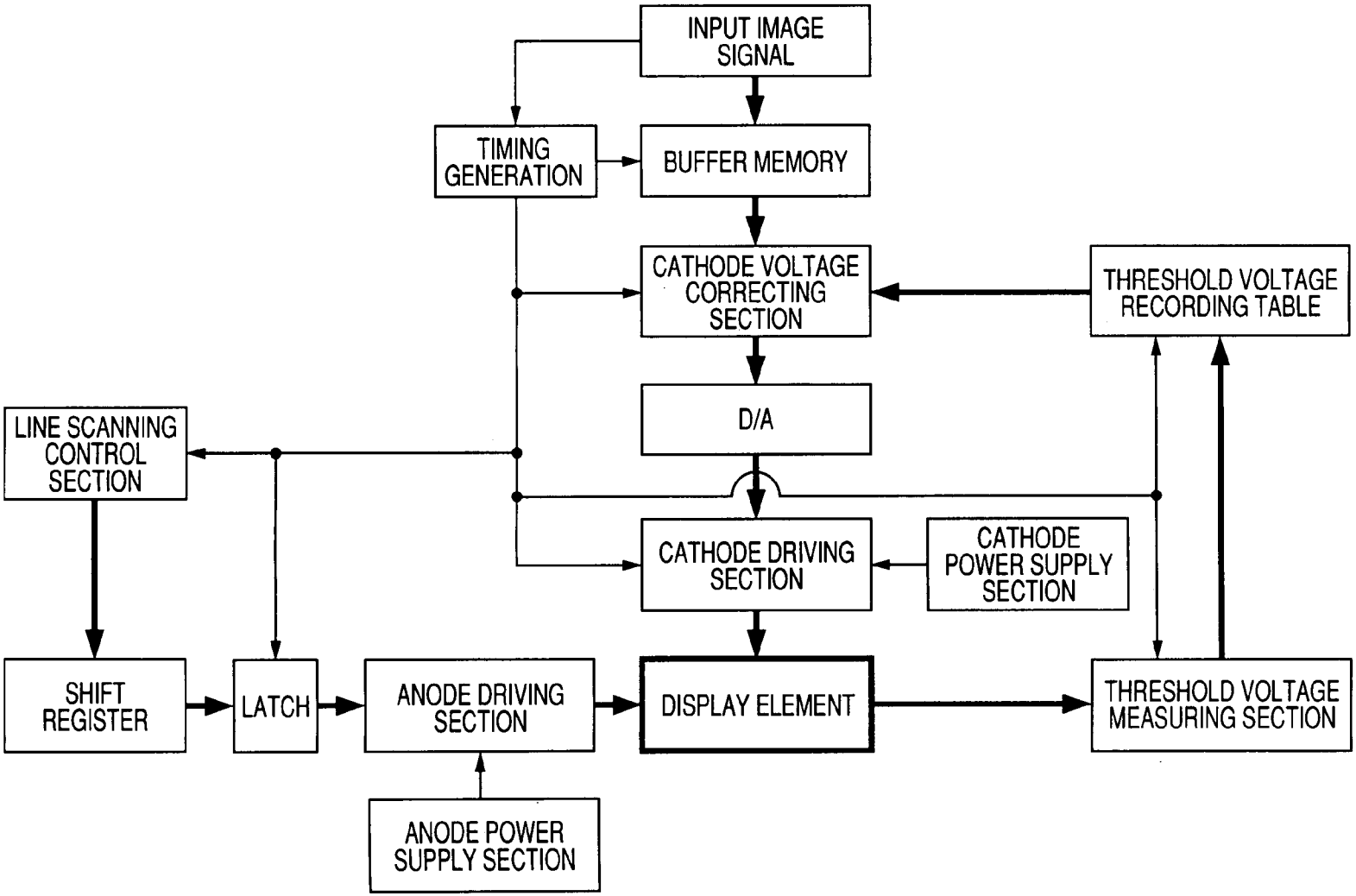
FIG. 13 is a block diagram showing the image display apparatus using the organic EL element.

FIG. 9 is a diagram showing the configuration of an electrode signal supply section of the image display apparatus using the organic EL according to this embodiment, FIG. 10 is a diagram showing a film configuration of a light emitting section of the organic EL element, FIG. 11 is a graph showing an interelectrode voltage—element current characteristic of the organic EL element used in this embodiment, FIG. 12 is a diagram showing a connection between the driving section and the organic EL element that is the display element, and FIG. 13 is an overall structural diagram showing the image display apparatus.

Referring to FIG. 9, the display apparatus according to this embodiment connects the respective anodes of the light emitting section (ELC) which are the pixels of the organic EL element (EL) to each other, and the respective cathodes thereof to each other to constitute the anode lines (AL) and the cathode lien (KL), and applies a given voltage to the respective lines to control the illumination/non-emission of the pixel.

The light emitting section (ELC) has a film structure shown in FIG. 10, and a hole injection layer (HIL), a light emitting layer (EM), an electron injection layer (EIL), and a cathode (K) are stacked on the anode (A) in the stated order.

When a voltage is applied between both ends of the light emitting section (ELC), the interelectrode voltage—element current characteristic is exhibited as shown in FIG. 11, and a voltage that is equal to or higher than the electron emission start voltage is applied to make a current flow to emit a light.

In this example, as shown in FIG. 9, the matrix structure is formed by the anode lines (AL) and the cathode lines (KL), and in a state where the voltage that is equal to or lower than the electron emission start voltage is applied so that no element current flows, there is an influence of the floating capacitance (Ck).

The respective anode lines (AL) are connected with anode driving sections (DA) which are capable of switching over two voltages consisting of a select voltage VaON and a non-select voltage Va which are supplied from the anode power supply (PA) and applying those voltages.

On the other hand, the cathode lines (KL) are connected with cathode driving sections (DK) which are capable of adjusting a voltage that is applied from the cathode power supply (PK) to a given voltage Vb according to the luminance, or cutting off the cathode lines (KL) from the cathode power supply (PK) to provide the high impedance state.

Therefore, as shown in FIG. 12, the cathode driving sections (DK) and the anode driving sections (DA) are connected so as to control the voltages of the respective anode lines (AL) and the respective cathode lines (KL), individually.

When an image is displayed, the anode lines (AL) side is sequentially selected, and a voltage necessary for illumination of the respective pixels is applied to the cathode line (KL) side to conduct the image display.

Hereinafter, the operation step in the case of emitting a light from the light emitting section (ELC) on the j-th anode line (AL(j)) shown in FIG. 9 will be described.

First, the non-select voltage VaOFF is applied to all of the anode lines including the j-th anode line. In this state, the cathode driving sections (DK) switch over to the cathode power supply (PK) side, and a voltage Vb necessary for the illumination of the pixels at the intersection points of the j-th anode line (AL(j)) and the respective cathode lines (KL) is applied to the cathode lines (KL). The floating capacitances exist in the respective cathode lines (KL), and are charged by the applied voltage. In this state, the anode electrode Va is the non-select voltage VaOFF, and a voltage between the anode (A) and the cathode (K) is set to be equal to or lower than the electron emission start voltage, and therefore no illumination is generated (period 1).

Thereafter, after the cathode driving section (DK) switches over to the open side, and the cathode lines (KL) and the anode power supply (PK) are cut off, the select voltage VaON is applied to the j-th anode line (AL(j)). In the pixels on the cathode lines that have been electrically charged in the period 1, the element current flows between the anode (A) and the cathode (K) in order to discharge the accumulated electric charge, and illumination is generated according to the quantity of accumulated electric charge. On the other hand, in the pixels on the cathode lines that have not been electrically charged in the period 1, since there is no electric charge to be accumulated, no element current flows and no illumination is generated (period 2).

In the pixels that have been electrically charged, a peak current flows according to the interelectrode voltage—element current characteristic shown in FIG. 11, but because the cathode lines (KL) are cut off from the cathode power supply (PK), the cathode (K) voltage gradually approaches the anode (A), and when the interelectrode voltage Vak reaches the electron emission start voltage, no element current flows with the result that the interelectrode voltage Vak is not equal to or lower than the electron emission start voltage.

Until the interelectrode voltage Vak reaches the electron emission start voltage, an integration value of the element current amount, that is, the quantity of electric charge that flows in the element in one illumination period is represented by a difference between the voltage Vb that is applied to the cathode lines (KL) in the period 1 and the threshold voltage Vth at the time of terminating the discharge, and the floating capacitance Ck as with the FED. The floating capacitance Ck can be measured.

In addition, in the discharge (illumination) period of the period 2, since the electric charge is sufficiently discharged immediately before the supply voltage of the j-th anode line (AL(j)) switches over from the select voltage VaON to the non-select voltage VaOFF, the voltages of the respective cathode lines at that time are measured, thereby making it possible to measure the threshold voltage Vth of the pixels on the j-th anode line (AL(j)) by means of the threshold voltage measuring section (VM).

The voltage (Vb−Vth) required to charge electric charge that contributes to the illumination can be obtained from the interelectrode voltage—element current characteristic, the illumination efficiency of the light emitting section (ELC), and the floating capacitance Ck. Therefore, the voltage Vb to be applied in the period 1 can be obtained.

With the structure shown in FIG. 13, the linear sequential scanning of the anode lines and the threshold voltage measurement of the respective cathode lines are combined together, the threshold voltages of the respective pixels within the display element is measured by the threshold voltage measuring section, and the measured threshold voltages are recorded in the threshold voltage recording table. Correction is made on the basis of the threshold voltage on the threshold voltage recording table, and the voltage value Vb necessary to obtain the illumination intensity that is required by the luminance signal is obtained during the subsequent illumination period.

When the threshold voltage measurement, recording, and correction cycle is conducted in the respective display periods (for example, every 1/60 seconds), the luminance can be more accurately corrected. Alternatively, it is possible to select the proper measurement period according to the variation status of the threshold voltage of the display element.

The quantity of electric charge that flows in the pixel within one light emitting period is controlled by the aid of the above threshold voltage measurement and correction, to thereby obtain an image display apparatus that is excellent in the illumination uniformity even in the case where the organic EL element is used as the display element. Even in the case where the organic EL is used as the display element, the correcting section having the arithmetic function shown in FIG. 6 is effective.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A flat panel display apparatus comprising: a first electrode line; a second electrode line; a pixel that is disposed at an intersection portion between the first electrode line and the second electrode line; a first electrode driving section that applies a voltage corresponding to a luminance signal to the first electrode line; a second electrode driving section that applies a select voltage to the second electrode line; a floating capacitance that temporarily holds the voltage corresponding to the luminance signal within a select period set by the select voltage; a voltage measuring section that measures the voltage of the first electrode line immediately before the select period is terminated in a state where the first electrode line is opened by the first electrode driving section; a recording table that records the measured voltage value; and a voltage correcting section that corrects the voltage corresponding to the luminance signal which is applied to the first electrode line on the basis of the recorded voltage value, further comprising a light emitting element having an organic light emitting layer located between the first electrode and the second electrode.

2. The flat panel display apparatus according to claim 1, further comprising an arithmetic processing section that conducts arithmetic processing by using the voltage value that is recorded in the recording table and the newly measured voltage value, and records the arithmetic result in the recording table as a new voltage value.

3. The flat panel display apparatus according to claim 1, wherein the second electrode driving section applies a non-select voltage to the second electrode line, and the first electrode driving section opens the first electrode line after the first electrode driving section applies the voltage corresponding to the luminance signal to the first electrode line to electrically charge the floating capacitance, and applies the select voltage to the selected second electrode line.

4. The flat panel display apparatus according to claim 1, wherein an external capacitance is added to the first electrode line.

5. The flat panel display apparatus according to claim 1, further comprising: a first electrode that is connected to the first electrode line; and a second electrode that is connected to the second electrode line, wherein electrons that are emitted from the first electrode are injected into a phosphor screen panel through a space that is reduced in pressure so as to be lower than the atmospheric pressure, and illumination is generated from the phosphor screen to display an image.

6. The flat panel display apparatus according to claim 5, wherein a display element containing fiber carbon material is disposed on the surface of the first electrode.

7. A flat panel display apparatus comprising: a first electrode that is connected to the first electrode line: and a second electrode that is connected to the second electrode line, wherein electrons that are emitted from the first electrode are injected into a phosphor screen panel through a space that is reduced in pressure so as to be lower than the atmospheric pressure, and illumination is generated from the phosphor screen to display an image, a first electrode line; a second electrode line; a pixel that is disposed at an intersection portion between the first electrode line and the second electrode line; a first electrode driving section that applies a voltage corresponding to a luminance signal to the first electrode line; a second electrode driving section that applies a select voltage to the second electrode line; a floating capacitance that temporarily holds the voltage corresponding to the luminance signal within a select period set by the select voltage; a voltage measuring section that measures the voltage of the first electrode line immediately before the select period is terminated in a state where the first electrode line is opened by the first electrode driving section; a recording table that records the measured voltage value; and a voltage correcting section that corrects the voltage corresponding to the luminance signal which is applied to the first electrode line on the basis of the recorded voltage value, wherein, in a state where electrons are emitted from the first electrode, when it is assumed that a first electrode voltage is Vk, a second electrode voltage is Vg, a phosphor screen voltage is Vp, a distance between the phosphor screen and the first electrode is dpk, and a distance between the phosphor screen and the second electrode is dpg, the display element that satisfies $dpk>dpg$, and $Vg<(Vp-Vk)/dpk\times(dpk-dpg)+Vk$ is used.

8. A flat panel display apparatus comprising: a first electrode that is connected to the first electrode line; and a second electrode that is connected to the second electrode line, wherein electrons that are emitted from the first electrode are injected into a phosphor screen panel through a space that is reduced in pressure so as to be lower than the atmospheric pressure, and illumination is generated from the phosphor screen to display an image, a first electrode line; a second electrode line; a pixel that is disposed at an intersection portion between the first electrode line and the second electrode line; a first electrode driving section that applies a voltage corresponding to a luminance signal to the first electrode line; a second electrode driving section that applies a select voltage to the second electrode line; a floating capacitance that temporarily holds the voltage corresponding to the luminance signal within a select period set by the select voltage; a voltage measuring section that measures the voltage of the first electrode line immediately before the select period is terminated in a state where the first electrode line is opened by the first electrode driving section; a recording table that records the measured voltage value; and a voltage correcting section that corrects the voltage corresponding to the luminance signal which is applied to the first electrode line on the basis of the recorded voltage value, wherein, in a state where electrons are emitted from the first electrode, when it is assumed that a first electrode voltage is Vk, a second electrode voltage is Vg, a phosphor screen voltage is Vp, a distance between the phosphor screen and the first electrode is dpk, and a distance between the phosphor screen and the second electrode is dpg, the display element that satisfies that an absolute value of dpk−dpg is equal to or smaller than the thicker film of the first electrodes and the second electrodes, and $Vg \leqq Vk$ is used.

* * * * *